United States Patent [19]

Marchesini et al.

[11] 4,033,152

[45] July 5, 1977

[54] APPARATUS FOR WASHING AND SUBSEQUENT DRYING OF BOLTS OF FABRICS

[75] Inventors: Bruno Marchesini, Trissino; Fernando Martini, Piovene Rocchette, both of Italy

[73] Assignee: Rimar Meccanica S.p.A., Carpenedolo, Italy

[22] Filed: Mar. 3, 1976

[21] Appl. No.: 663,490

[30] Foreign Application Priority Data

Mar. 7, 1975 Italy ..... 21028/75

[52] U.S. Cl. ..... 68/19.1; 68/20; 68/53; 68/62; 68/178; 68/202; 68/205 R; 68/DIG. 5

[51] Int. Cl.[2] ..... D06B 3/20; D06B 21/02

[58] Field of Search ..... 68/19.1, 20, 53, 62, 68/175, 177, 178, 179, 202, 205 R, DIG. 5

[56] References Cited

UNITED STATES PATENTS

| | | | |
|---|---|---|---|
| 3,681,946 | 8/1972 | Fleissner | 68/177 X |
| 3,762,866 | 10/1973 | Rayment et al. | 68/178 X |
| 3,837,188 | 9/1974 | Schuierer | 68/20 |
| 3,950,968 | 4/1976 | Vecchia | 68/178 X |

FOREIGN PATENTS OR APPLICATIONS

| | | | |
|---|---|---|---|
| 509,254 | 10/1930 | Germany | 68/177 |

*Primary Examiner*—Philip R. Coe

[57] ABSTRACT

An apparatus is disclosed for washing and subsequent drying of bolts of fabrics which comprises means for continuously delivering the fabric into a fixed basket provided with substantially semicylindrical and coaxial outer and inner walls. The outer wall is partially perforated. An agitator is positioned in juxtaposition with the perforations and has a plurality of mobile paddles thereon. A chamber containing the outer wall of the basket and the agitator serves the purpose of containing therein a liquid solvent. A rotatable drum is mounted coaxially with respect of the inner and outer walls of the basket and has a diameter smaller than the diameter of the inner wall. Hot air is forced through the perforations of the drum through a close-loop circuit. A series of guide rolls guide the fabric from the basket tangentially on a portion of the perforated drum.

7 Claims, 2 Drawing Figures

APPARATUS FOR WASHING AND SUBSEQUENT DRYING OF BOLTS OF FABRICS

Figure 1:
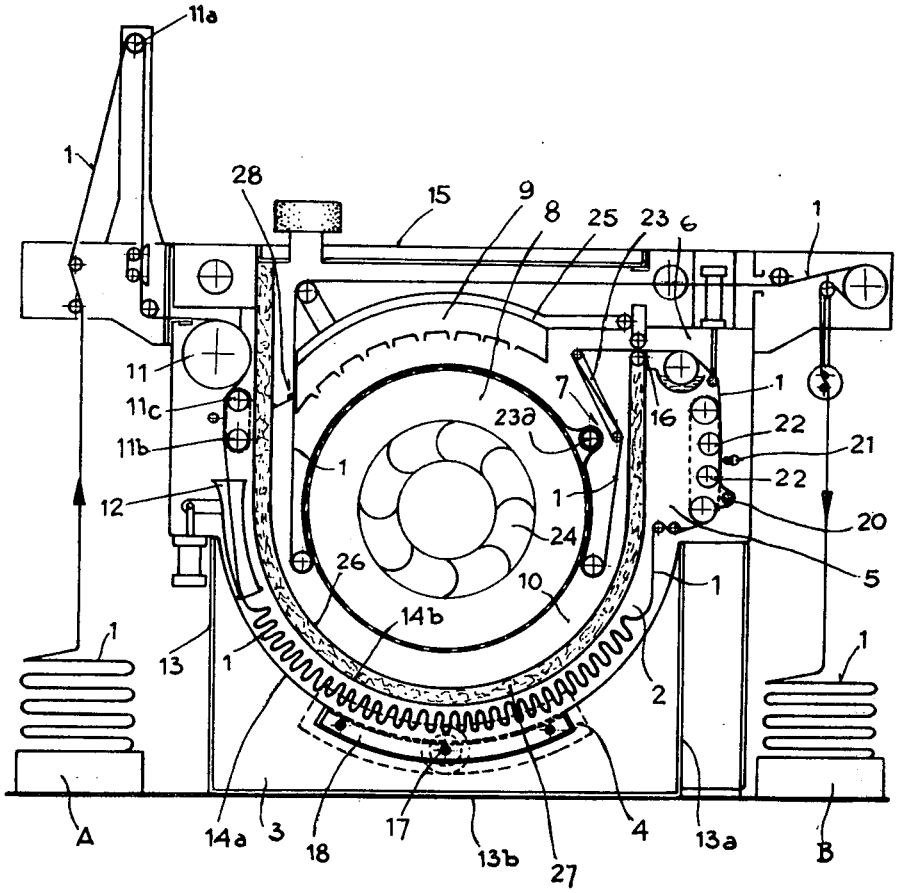

The present invention relates to apparatus for washing and subsequent drying of bolts of fabrics, that is, lengths of fabrics which are continuously fed such as from a loom.

Machines as known for washing fabrics which are continuously fed into one end of the apparatus and withdrawn from the opposite end after having been passed through an intermediate section of the machine wherein they are generally subjected to a solvent bath treatment and to a mechanical treatment. Equally known are drying apparatus, for example of the drum type, on the periphery of which the fabrics are tangentially drawn after having passed through a separate washing machine.

It is well known that these distinct and separate devices require substantial floor space so that their combined structures occupy relatively large plant surface as well as requiring a substantial capital outlay. Further, the operator of one of these machines cannot possibly attend to the operation of the other, thus requiring the employment of a substantial labor force.

The present invention obviates these drawbacks by utilizing a single apparatus of compact structure and occupying a substantially reduced floor space substantially equivalent to that of one of the heretofore mentioned separate devices and capable of washing as well as of drying the bolt of fabric with efficiency and economy.

Therefore, the apparatus of the invention has the advantage of requiring very little floor space, comparable, for example from an external geometric dimensional viewpoint, to that of a batch-type washing device, the apparatus of the invention having of course all of the advantages derived from a continuous feeding of the fabric. The labor costs obviously are considerably reduced, since a single operator may attend to the entire washing and drying operations.

Briefly stated, the apparatus of the invention is characterized in that it is provided with means for the continuous delivery of a fabric into a fixed basket defined by two walls substantially semicylindrical and coaxial to each other. The outer wall is partially perforated in correspondence with an agitator having mobile paddles, the said wall being contained together with said agitator within a chamber which is defined by the inner wall of the basket and by the lateral walls and bottom surface of a tub containing a liquid solvent. A perforated and rotatable drum in coaxially mounted with the said two walls of the basket and has a diameter smaller than that of the inner wall of the basket. Means are provided to cause the passage of hot air within a close circuit path toward the inside of the perforated drum. Also provided are guiding means to guide the fabric from the basket tangentially along a portion of the outer periphery of the drum.

Figure 2:
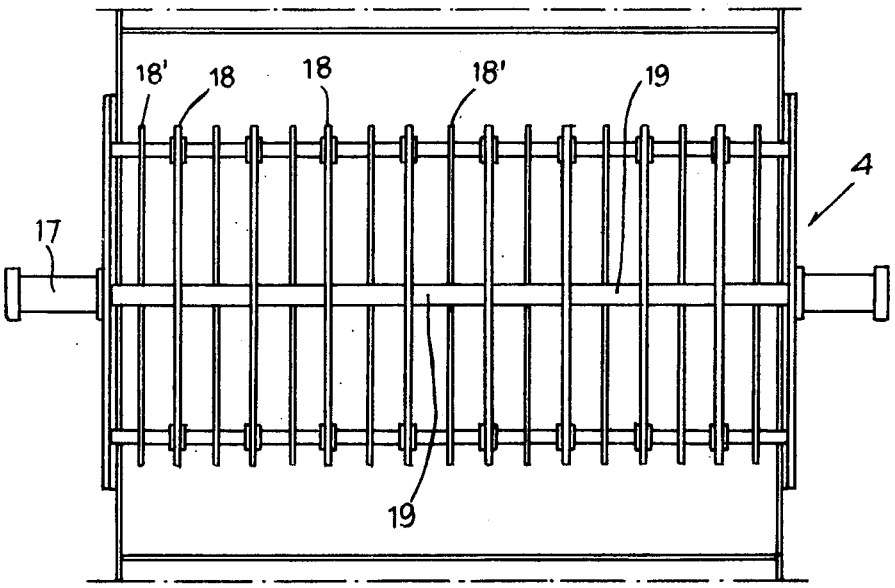

The above advantages and features of the apparatus of the present invention will become apparent from the following detailed description of the invention in its preferred embodiment and with reference to the accompanying drawings in which:

FIG. 1 is a schematic view in longitudinal section and in the direction of advance of the fabric, of the apparatus of the invention; and FIG. 2 is a bottom view of an embodiment of the apparatus showing the mobile paddles for the creation of the mechanic action required for washing.

Referring now to the drawings, FIG. 1 shows schematically the apparatus, wherein a fabric 1 originating from the loom (for example a jersey type fabric made of artificial or natural fibers) and not yet degreased, is washed, then eventually treated with a special resin-based substance, and finally dryed and readied for the eventual dyeing. From point A, which indicates the end of the loom knitting operation and which may be envisage as constituting, for example, a bolt or roll of lengths of fabric united to one another lengthwise, the apparatus of the invention delivers at point B the fabric completely degreased, suitably treated and ready for the subsequent eventual dyeing operations.

The fabric 1 is guided by a plurality of rolls and cylinders, some of which are shown at 11, 11*a* and 11*b* and of which rolls at least one is a driving roll, to the inside of a washing basket 2. Basket 2 is provided, as it is known in the art, with a funnelled pedestal 12 to facilitate the introduction of the fabric 1 into the basket 2. Basket 2 which is of the fixed type, comprises two coaxially curved walls of substantially semicircular cross-section. The inner wall 14*b* extends, at the entrance side of the fabric, to the upper wall 15 which covers the apparatus and extends, at the exit side of the fabric, to a point indicated at 16 through which the fabric passes from the washing section to the drying section of the apparatus. The drying section is thus separated from the washing section. The outer wall 14*a* defines toward the bottom a chamber or tub 3 which is defined by the side walls (of which those indicated at 13 and 13*a* are shown) and by the bottom wall 13*b*. These walls constitute at least partially also the external supporting structures and covering structures of the apparatus. A portion of wall 14*a* is perforated, at least in correspondence with agitator 4, which is provided with mobile paddles so as to embrace through a given arc the lowermost central section of wall 14*a*.

Referring to FIG. 2, there is shown a preferred embodiment of said agitator 4, which however may be structurally at variant with the one illustrated as long as it lends itself to the movement of some elements thereof so that, when the means 4 is immersed in a liquid solvent contained in tub 3, fluid currents are forcedly passed through the perforated portion of wall 14*a*, penetrating into basket 2 and exerting a mechanical action of the fabric 1 during washing. Following the embodiment of FIG. 2, agitator 4 comprises a plurality of mobile paddles 18 parallel to one another and mounted equally spaced on a central pivot 19 which is transversely positioned with respect to basket 2 and is connected, through external element 17, to driving means capable of exerting a reciprocating displacement. A plurality of fixed paddles 18' is integrally connected with the walls of basket 2, each of said paddles being positioned between two adjacent mobile paddles 18. Each fixed paddle is provided at its central portion with an aperture to allow for the passage and reciprocating motion therethrough of said pivot 19. During this motion of the pivot there are thus created between the mobile paddles and the fixed ones increases and decreases of volume with the resultant forced displacement of the liquid. The liquid is thus subjected to a pump-like effect. The liquid, which is present within the basket and which is in fluid communication with tub 3 through the perforations of wall 14*a* (thus effecting a chemical action on the fabric 1), will exert in a dynamic condition also a mechanical action on the fabric, that is it will cause any grease and dirt particles to detach themselves from the fabric.

Fabric 1, in its travel, after exiting from the basket 2, reaches a rinsing section 5, after of course having passed through a widening roll 20, through one or more solvent sprayers 21 and through one or more suction rolls 22. Subsequently, the fabric may be introduced, as shown, into a treating section 6, such as a bath for the application of predetermined substances, e.g. resins, to lend the fabric desired properties, e.g. spotproofing, creaseproofing, etc. The fabric passes through point 16 which is defined by a pair of opposed rolls and enters the drying section which is located substantially above and inside of the washing basket 2, as shown in FIG. 1. More particularly, the fabric passes initially through a pre-drying section 7 before coming into contact with drying drum 8, so as to prevent that the resinous material applied to the fabric at 6 clog the drum. In section 7, the fabric follows a path of predetermined length determined by the various guiding rolls and cyliners, among which there is preferably provided a "compensating" roll 23*a* for keeping the fabric correctly stretched and preventing it from varying its length because of the elevated temperature at which the fabric enters section 7. The drying drum 8 is coaxially mounted with respect to basket 2, so as to avoid any waste of useful space and to render the apparatus as compact as possible. Drum 8 is of the type preferably with a fully perforated periphery and is provided with means 23 for displacing the fabric, said means being described in detail in Italian Pat. No. 901627 issued to the applicant of this application. As illustrated in the drawings, an axial fan 24 is coaxially mounted with the drum 8 and inside thereof. Fan 24 serves the purpose of forcing inwardly through the perforations of drum 8 the hot air originating from a recycle section 9, so as to direct it through an extremity of the fan-drum unit and toward a filter and recovery section (not shown) of particles of solvent and resins carried by the air stream. The hot air is then passed through the fabric to be dryed and returned to the recycle section 9. The temperature of chamber 10 surrounding drum 8 and comprised between the drum, the inner wall 14*a* of the basket, an upper wall 25 (defining recycle section 9) and the two frontal walls of the apparatus (not shown), is substantially elevated and is of the order of about 120° C. It is therefore preferred to have some thermal insulation between chamber 10 and the inner wall 14*a* of the basket 2, within which basket the temperature is of the order of 40° to 50° C. Such insulation may be obtained for example by providing a second wall 26, parallel to and inside of wall 14*b*, so as to define with the latter a spacing 27 which may be suitably filled with thermally insulating material.

Fabric 1 subsequently exits the drying section through opening 28, which similarly to the entrance opening 16 should be as limited as possible in order to prevent heat losses toward the outside. Additional limitation in heat losses is obtained from the slight depression existing in chamber 10 and in section 7 (pre-drying). The fabric then proceeds toward the exit passing through wall 25 and the upper cover wall 15, always guided and, if desired dragged, by a plurality of guide rolls, until the fabric reaches point B perfectly washed and dryed.

It can be seen from the above that fabric 1, within the apparatus of the present invention, is subjected to a complete series of treatments, following a considerably lengthy path, but nevertheless remaining always within the boundaries of the compact apparatus. A single operator may attend to the entire complex of operations and to the maintenance of the apparatus, thanks to the provision of removable cover walls such as for example wall 15. A visual inspection of the inner components of the apparatus is therefore quite readily achieved.

Additions and/or modifications to the apparatus may be effected without exiting from the scope of the invention. For example, the agitator 4 may be altered in its structure, as hereinbefore mentioned, and other treating steps or means for plural treatments may be added between the washing section and the drying section, as it is known to the experts in the field.

What is claimed is:

1. Apparatus for washing and subsequently drying bolts of fabrics, which comprises: means for continuously delivering a fabric; a fixed basket for receiving said fabric and having outer and inner walls substantially semicylindrical and coaxial to each other; said outer wall being partially perforated; agitating means positioned in juxtaposition with said perforations and having a plurality of mobile paddles thereon; a chamber defined in part by said outer wall and containing said agitating means, and having side walls and bottom wall and being defined by said side walls, said bottom wall and said outer wall; said chamber serving to contain a liquid solvent therein; a perforated, rotatable drum coaxially mounted with respect to said inner and outer walls of said basket and having a diameter smaller than the diameter of said inner wall; means for forcing hot air through said perforated drum in a closed fluid circuit; and guiding means to guide said fabric from said basket tangentially onto a portion of said perforated drum.

2. The apparatus of claim 1, wherein said agitating means comprises, in correspondence with the lower central portion of said outer wall of said basket, a plurality of paddles parallel to one another and parallel to the direction of travel of said fabric, said paddles being fixed on a central pivot, said pivot being connected to driving means for the longitudinal reciprocating displacement of said pivot; said agitating means further comprising a plurality of fixed paddles positioned alternately between adjoining mobile paddles.

3. The apparatus of claim 1 further comprising, intermediate the exit point of said basket and the contact point of the said fabric with said drum, a rinsing section which comprises spraying nozzles for said solvent and suction cylinders for a partial pre-drying of said fabric.

4. The apparatus of claim 3 further comprising, upstream of said rinsing section, means for treating chemically said fabrics by means of resins.

5. The apparatus of claim 4 further comprising upstream of said treating means and downstream of said contact point of said fabric with said drum a pre-drying section, said pre-drying section being defined by the periphery of said drum, said inner wall of said basket and an upper wall of said apparatus.

6. the apparatus of claim 1 wherein said means for forcing said hot air comprise an axial suction fan positioned within said drum; a recycle section from which said hot air is sucked by said fan, and a closed circuit conduit unit for said hot air.

7. The apparatus of claim 1 wherein the points of entrance into and exit from said chamber are sectionally substantially reduced to the cross-sectional dimensions of said fabric.

* * * * *